US008651983B2

(12) United States Patent
Chen

(10) Patent No.: US 8,651,983 B2
(45) Date of Patent: Feb. 18, 2014

(54) SWING GAME

(76) Inventor: Samuel Chen, Shanghai (CN)

( * ) Notice: Subject to any disclaimer, the term of this patent is extended or adjusted under 35 U.S.C. 154(b) by 155 days.

(21) Appl. No.: 13/403,178

(22) Filed: Feb. 23, 2012

(65) Prior Publication Data

US 2013/0143701 A1 Jun. 6, 2013

Related U.S. Application Data

(60) Provisional application No. 61/566,459, filed on Dec. 2, 2011.

(51) Int. Cl.
*A63B 67/00* (2006.01)
*A63G 9/00* (2006.01)

(52) U.S. Cl.
USPC ..... 473/465; 473/415; 472/118

(58) Field of Classification Search
USPC ..... 473/465, 415, 428, 427; 273/359; 5/101–109; 472/117–119; 446/322, 446/324; 482/27–32, 23; 297/183.3, 184.3, 297/247, 258.1, 259.3
See application file for complete search history.

(56) References Cited

U.S. PATENT DOCUMENTS 1,369,616 A * 2/1921 Bunt ..... 297/258.1
1,393,456 A * 10/1921 Ruggles ..... 434/38
1,436,481 A * 11/1922 Cook ..... 248/370
1,436,834 A * 11/1922 Van Atti ..... 297/9
2,251,141 A * 7/1941 Lehman, Jr. ..... 297/186
2,439,632 A * 4/1948 Ramirez ..... 297/246
2,562,745 A * 7/1951 Sebel ..... 297/259.3
2,932,824 A * 4/1960 Bischoff ..... 446/324
3,241,878 A * 3/1966 Beery ..... 297/257
4,036,489 A * 7/1977 Potyondy ..... 472/44
4,114,313 A * 9/1978 Guerrero et al. ..... 446/191
4,377,011 A * 3/1983 Kinberger ..... 5/102
4,402,500 A * 9/1983 Coles ..... 472/17
4,978,120 A * 12/1990 Greenwood ..... 472/18
4,986,599 A * 1/1991 Wise ..... 297/183.3
5,011,221 A * 4/1991 Wise ..... 297/188.06
5,449,323 A * 9/1995 Melton ..... 472/118
5,562,548 A * 10/1996 Pinch et al. ..... 472/119
7,276,033 B2 * 10/2007 Phillips ..... 601/23
7,326,120 B2 * 2/2008 Bellows et al. ..... 472/119
8,100,475 B2 * 1/2012 Habing ..... 297/260.1
8,316,481 B2 * 11/2012 Arnold et al. ..... 5/93.2
2004/0067830 A1 * 4/2004 Rovere et al. ..... 482/140
2012/0277013 A1 * 11/2012 Chapman et al. ..... 472/119
2013/0198951 A1 * 8/2013 Arnold et al. ..... 5/93.2

* cited by examiner

*Primary Examiner* — Mitra Aryanpour
(74) *Attorney, Agent, or Firm* — Clement Cheng

(57) ABSTRACT

A swing ball game has a top support frame member. A swing hangs from the top support frame member. The swing has a swing seat configured to swing in a front and rear direction. At least one vertical support frame member is connected to the top support frame member and supports the top support frame member. A rocker support frame member has a rocker bottom profile. The vertical support frame member is connected to the rocker support frame member. The rocker support frame member is oriented sideways so that the top support frame member can rock in a left and right direction.

18 Claims, 5 Drawing Sheets

SWING GAME

This application is a nonprovisional application claiming priority from inventor Samuel Chen's U.S. provisional patent application No. 61/566,459 filed Dec. 2, 2011 entitled Swing Game, the disclosure of which is incorporated herein by reference.

FIELD OF THE INVENTION

The present invention is in the field of swing games.

DISCUSSION OF RELATED ART

A variety of different swing ball games have been discussed in prior art such as Publicover publication 2005/0049055 entitled Play Swing Systems and Methods Of Play published Mar. 3, 2005, the disclosure of which is incorporated herein by reference. A bag or net holding a reservoir of water balloons can be attached to a swing seat so that a user can grab them one at a time and throw them at targets. To keep the player from falling out while the player is swinging arms and legs while throwing objects, it is suggested to have a harness strap connecting the user to the swing seat.

SUMMARY OF THE INVENTION

A swing ball game has a top support frame member. A swing hangs from the top support frame member. The swing has a swing seat configured to swing in a front and rear direction. At least one vertical support frame member is connected to the top support frame member and supports the top support frame member. A rocker support frame member has a rocker bottom profile. The vertical support frame member is connected to the rocker support frame member. The rocker support frame member is oriented sideways so that the top support frame member can rock in a left and right direction.

The one or more vertical support frame members may comprise four vertical supports, namely a right front vertical support frame member, a left front vertical support frame member, a right rear vertical support frame member, and a left rear vertical support frame member. The rocker support frame member can be formed as a rear rocker support frame member and a front rocker support frame member. If the one or more vertical support frame members comprise four vertical supports, namely a right front vertical support frame member, a left front vertical support frame member, a right rear vertical support frame member, and a left rear vertical support frame member; then the rocker support frame member can be formed as a rear rocker support frame member and a front rocker support frame member so that the right front vertical support frame member and the left front vertical support frame member are connected to and supported by the front rocker support frame, and the right rear vertical support frame member and the left rear vertical support frame member are connected to and supported by the rear rocker support frame.

The swing seat may also have a ball release mechanism and a trigger assembly. In the trigger assembly has a trigger handle configured to actuate the ball release mechanism when the trigger handle is manipulated. The swing seat may also have a plurality of balls held within a projectile hollow. The projectile hollow can be formed as a projectile channel allowing stacking of the plurality of balls in linear orientation. A pair of bomb bay doors can be pivotally mounted to a bottom portion of the swing seat and open to release one or more of the plurality of balls when the trigger handle is manipulated. A projectile loading opening can be formed on a surface of the swing seat, so that the projectile loading opening is configured to receive a plurality of balls. The release finger can be mounted to the swing seat acting as a gate for controlling ball release.

The following call out list of elements can be a useful guide in referencing the element numbers of the drawings.

12 Top Support Frame Member
14 Rear Vertical Support Frame Member
15 Front Vertical Support Frame Member
16 Intermediate Support Frame Member
18 Rear Rocker Support Frame Member
19 Front Rocker Support Frame Member
21 Right Chain
22 Left Chain
23 Left Chain Sleeve
24 Right Chain Sleeve
25 Trigger Assembly
26 Crosshairs Sight
27 Pillar
28 Swing Seat Body
29 Bomb Bay Door
31 Cross Hairs Post
32 Projectile Opening
33 Trigger Handle
34 Trigger Mount
35 Pull Cable Terminal
36 Pull Cable Sheath
39 Projectile Loading Opening
41 Loading Plug
42 Bottom Plug
43 Front Plug
44 Projectile Front Opening
45 Projectile Channel
46 Outside Body Portion
47 Inside Body Portion
48 Tip Body Portion
49 Spring Retainer Plug
51 Release Pivot
52 Inside Spring Connection
53 Coil Spring
54 Spring Retainer Plug Connection
55 Sheath Grabber
56 Pull Cable
57 Outside Cable Connection
58 Release Finger
61 Outside Tip
62 Inside Tip
63 Concave
70 Ball
71 Ball Shell
72 Ball Hollow
73 Ball Internal Beads

DETAILED DESCRIPTION OF THE PREFERRED EMBODIMENT

Figure 1:
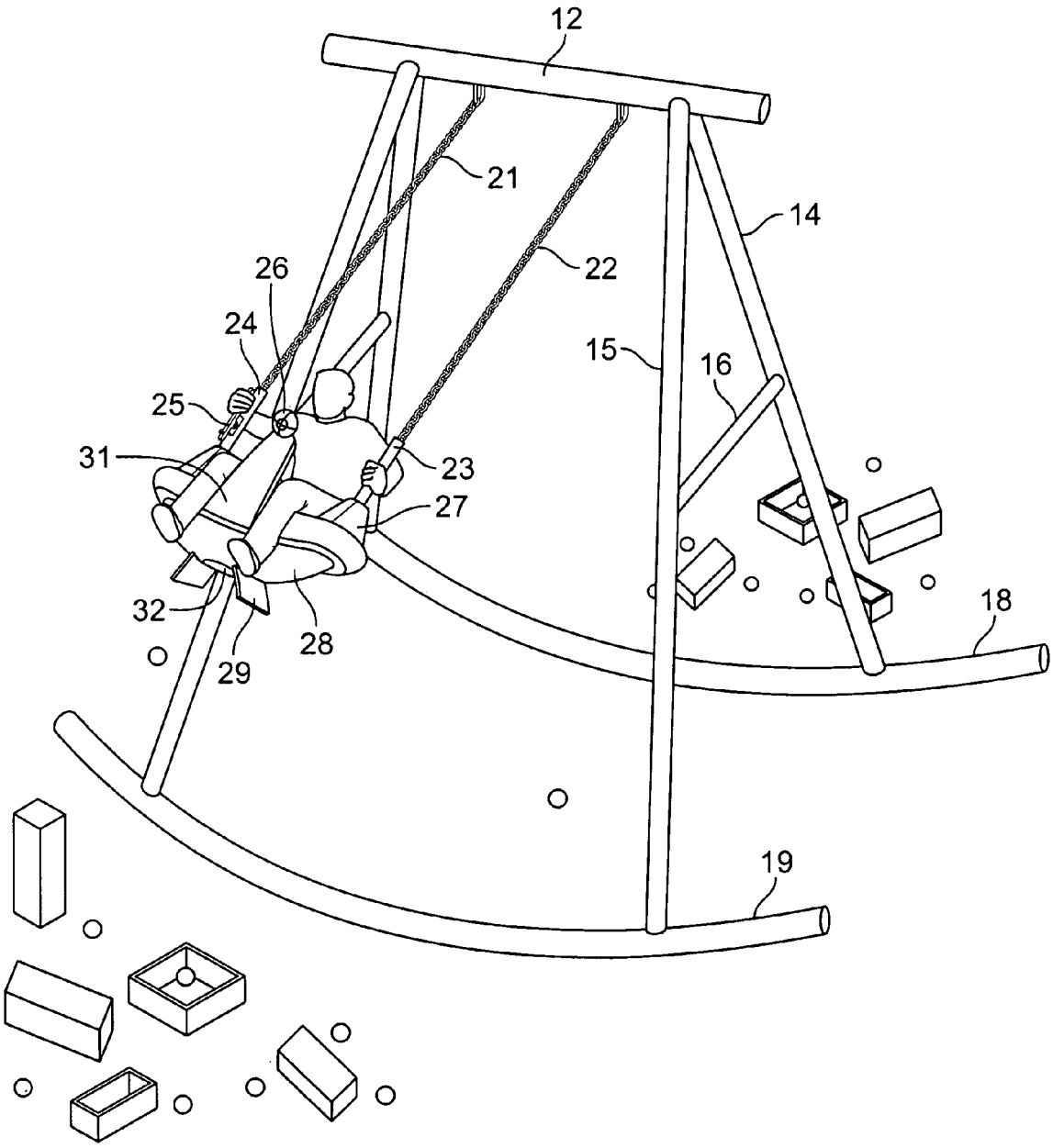
FIG. 1 is a perspective view of the swing apparatus.

The present invention shows a swing set having a top support frame member 12, FIG. 1 formed as a tube of metal and preferably welded to a pair of rear vertical support frame members 14 and a pair of front vertical support frame members 15. The frame welding is the most secure connection, but the top connection can also be by bolts. The rear vertical support frame member 14 and the front vertical support frame member 15 can be connected with an intermediate support frame member 16. The intermediate support frame member 16 is preferably generally horizontal and at a midpoint between the front vertical support frame member 15 and the rear vertical support frame member 14. The rear vertical support frame member 14 and the front vertical support frame member 15 are preferably angled to form an apex supporting the top support frame member 12. The bottom ends of the vertical support frame members are preferably rigidly connected to a pair of rocking members including a rear rocker support frame member 18 and a front rocker support frame member 19. The rocker support frame members allow the user to rock sideways as well as swing forward and backward. Optionally, the intermediate frame support member 16 can be attached to the rear rocker support frame member 18 and front rocker support frame member 19.

The top support frame member 12 has a pair of chain connections extending downward from a bottom surface of the top support frame member 12. The first chain connection connects to a right chain 21 and the second chain connection connects to a left chain 22. The right chain 21 is encapsulated within a right chain sleeve 24 at a lower end of the right chain 21. The left chain 22 is encapsulated within a left chain sleeve 23 at a lower end of the left chain 22. The right chain 21 is connected to a pillar 27 on the right side that extends from the swing seat body 28 on the right side. The left chain is connected to a pillar 27 on the left side that extends from the swing seat body 28 on the left side. The chain sleeve pair can be formed of a transparent plastic tube that is rigid or flexible.

The swing seat body 28 has a crosshairs post 31. The crosshairs post 31 can be tapered from a wide base to a narrow tip upon which the crosshairs sight 26 is mounted. The crosshairs sight 26 mounted on a crosshairs post 31. The crosshairs post 31 can be made removable by connection to a socket on the swing seat body 28 which retains the crosshairs post 31. The crosshairs post 31 when made removable can be detached and reattached to the swing seat body 28. The crosshairs can also be made as a sight without crosshairs and attached to a sight post. A wide variety of different reticle designs can be provided, but it is preferred that no glass is used, although a glass or plastic lens with or without magnification could be provided.

The swing seat body 28 also has a projectile opening 32 which can be located on an underside of the swing seat body 28. The first and second bomb bay door 29 can be attached to the bottom of the swing seat body 28. The trigger assembly 25 can be held by a right or left hand and mounted on the right or left chain so that a user can activate the trigger assembly while the user is gripping on the chain sleeves. The chain sleeves preferably have an external surface that is grippy. The chain sleeves may also receive a trigger assembly 25 mounting to the chain sleeves.

During play, a user may shift weight to the left or right and drop balls or other projectiles from the projectile opening 32 by actuating the trigger assembly 25. Targets such as boxes can be positioned to the front or back or underneath the swing so that the user can hit the targets with the projectiles. Games can be also be made where the projectiles are launched into an opening of a box so that the projectiles are retained within the box. Different scores can be assigned for putting a projectile inside a target or knocking over boxes or targets.

Figure 2:
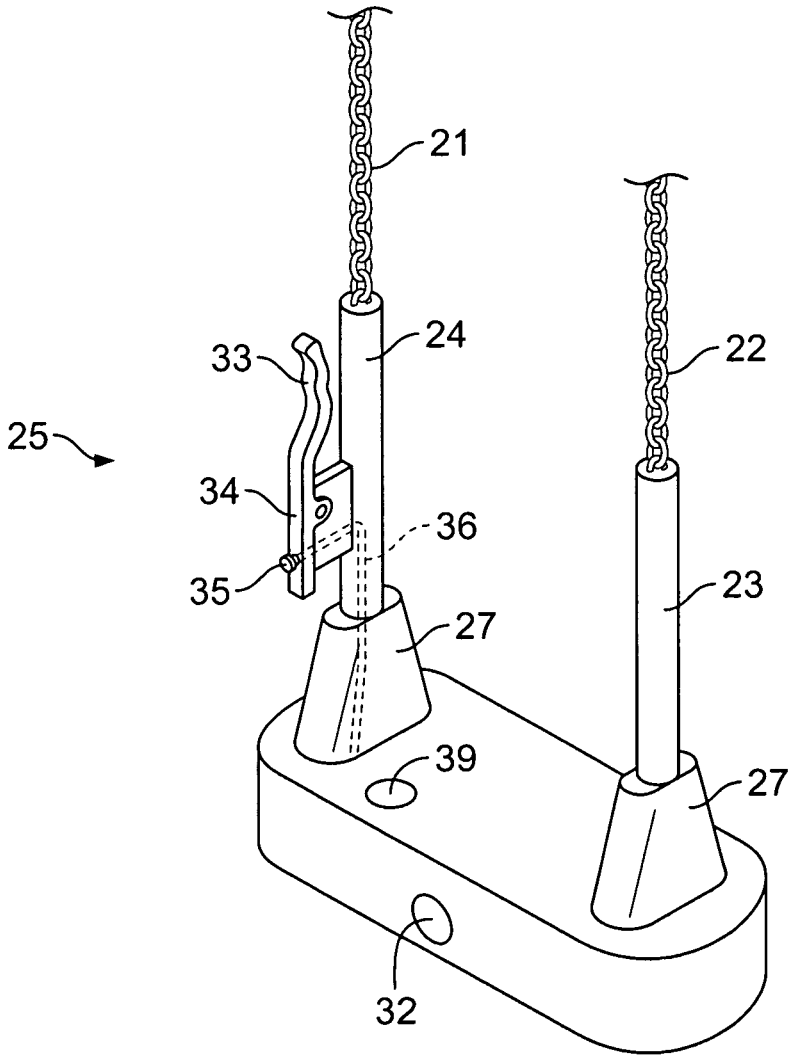
FIG. 2 is a close-up perspective view of a swing seat.

The swing seat body 28 optionally has a pair of pillars 27, and the pillars can be of varying height. The trigger assembly 25 preferably includes a trigger handle 33 extending upward from a trigger mount 34. The trigger handle 33, FIG. 2 is mounted to a swivel that is mounted to a swivel base. The swivel base is connected to the right chain sleeve 24 or left chain sleeve 23. The pull cord or pull cable preferably has a pull cable terminal 35 formed as a terminal connection. The terminal connection can be a plug attached to an end of the cable. The plug can be extended through an aperture located on a surface of the trigger handle 33. The pull cable is held within a pull cable sheath 36 for much of its length. The sheath is semi rigid and inflexible and extends from the swivel base into the sleeve and then downward through the pillar and into the swing seat body 28.

Figure 3:
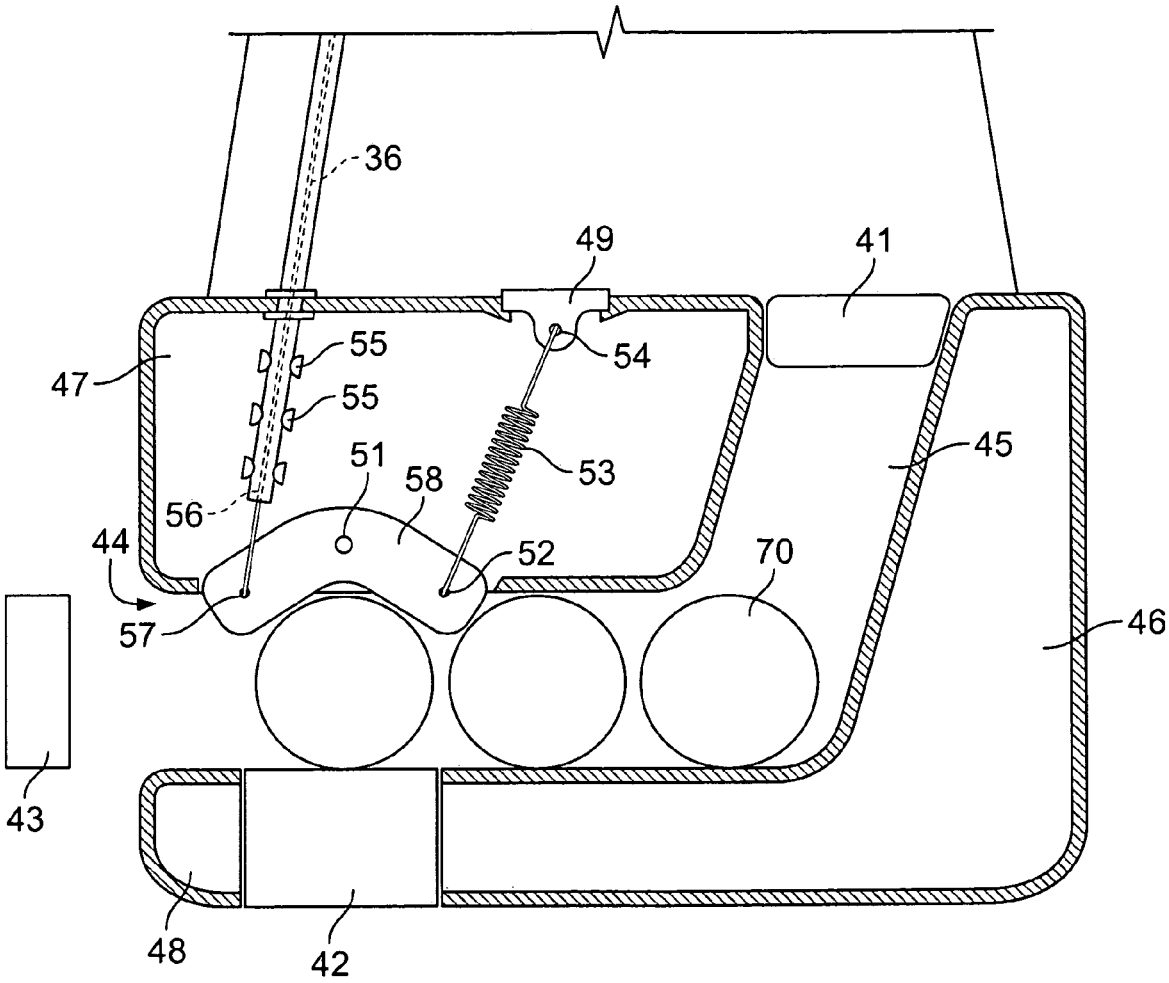
FIG. 3 is a cross-section view of a swing seat having a horizontal release.
Figure 4:
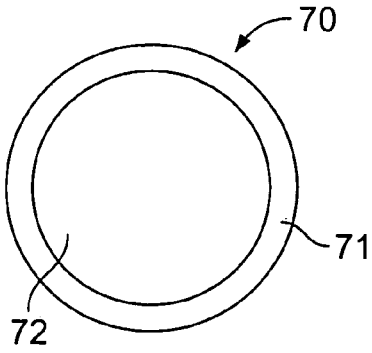
FIG. 4 is a cross-section view of a ball.
Figure 5:
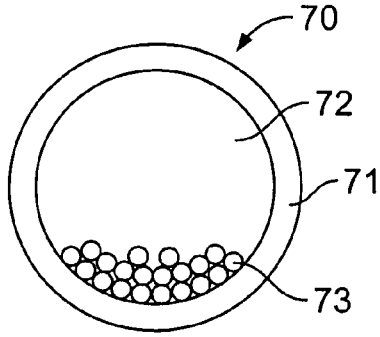
FIG. 5 is a cross-section view of a loaded ball.

The sheath can be retained by a plurality of sheath grabber 55, FIG. 3 which are formed in a blow molded side wall of the inside body portion 47 of the seat body. The sheath grabber 55 can be formed as a continuous channel or as small protrusions to the left and right of a sheath channel. The seat body is generally hollow blow molded plastic having a projectile channel 45 for retaining a plurality of projectiles such as balls 70.

The projectiles are loaded through a projectile loading opening 39 preferably located on a top or side surface of the seat body. The projectiles are released in a controlled fashion by a release finger 58 the release finger is a curved member that receives a ball or projectile in its concave angled portion. The concave portion preferably retains a single projectile, but could be sized to retain more than one. The concave portion of the release finger is located preferably between the inside spring connection 52 and the outside cable connection 57.

When a user moves the trigger handle 33 by squeezing it, the handle pulls on the pull cord that is retained in the sheath. The sheath is held in place by one or more sheath grabber 55 but can also be held by grommets. The pull cord 56 retracts the outside cable connection 57 and pulls the release finger 58 so that the release finger rotates on the release pivot 51. The inside spring connection 52 is connected to a coil spring 53 and the coil spring has a screen retainer plug connection 54 so that the pull cord pulls against the spring. The spring biases the pull cord back to a released position from an engaged position. The spring can be formed as multiple springs or the spring constant can be adjusted according to the friction to be overcome and force required. It is preferred that the coil spring 53 is mounted to a removable spring retainer plug 49 which can be used as a hatch for assembling the release finger apparatus as well as for servicing the spring in case the spring 53 breaks.

The spring retainer plug 49 inserts into an outside surface of an inside body portion 47. The spring retainer plug 49 preferably has a threaded connection to the seat body. Other plugs can be implemented for controlling the direction of the balls. For example, a front plug 43 can be inserted into a projectile front opening 44 and a bottom plug 42 can be inserted into a bottom opening of an outside body portion 46. The front plug 43 and the bottom plug 42 can both have threaded connection to the seat body. The projectile channel 45 can therefore be directed downward for a downward projectile release by removing the bottom plug and inserting the front plug 43 so that the balls are flying out from the bottom. Alternatively, the front plug 43 can be removed and the bottom plug 42 inserted so that the front plug 43 is not used and the balls are thus flying out from the front.

The loading plug 41 can be inserted in a side or top surface of the seat body. When the loading plug is inserted in a top surface of the seat body, the loading plug may provide a smooth top surface for the user seat.

The projectile can be a ball 70 and the ball can be hollow. The ball is preferably made to have a shell 71 and a ball hollow 72. Optionally, articles can be inserted within the ball such as ball internal beads 73 to provide varying projectile properties.

Figure 6:
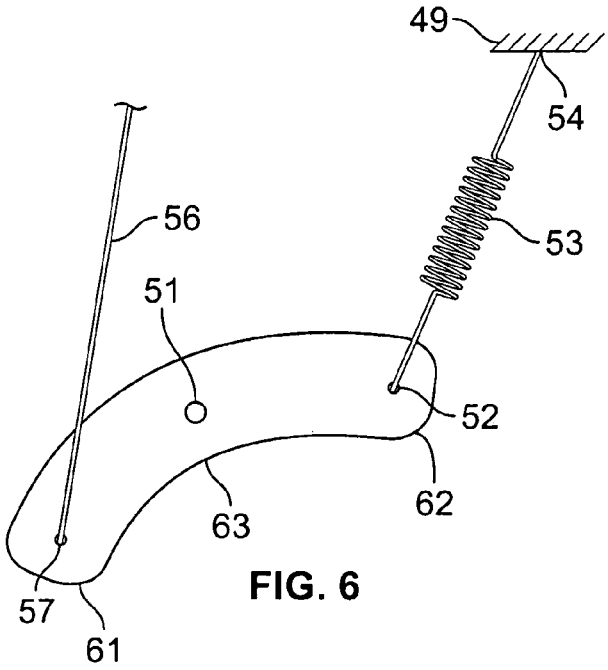
FIG. 6 is a diagram of a low angle ball release finger.

The shallow concave seen in FIG. 6 may allow for multiple ball launching. The release finger can be made as a shallow concave 63 with a low angle so that the front tip 61 retains the ball to be launched in trigger released position but not in trigger pulled position. The low angle release finger can have the back tip 62 not retain the line of balls in both the trigger pulled position and in the trigger released position. By having the back tip 62 out of the way, a user can launch multiple balls in a single pull.

Figure 7:
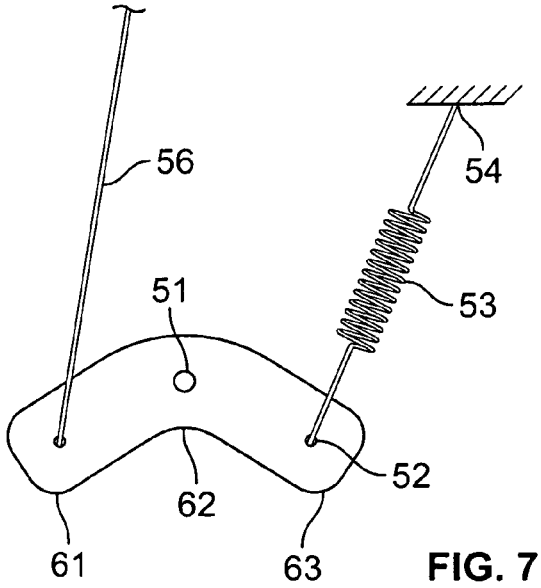
FIG. 7 is a diagram of a high angle ball release finger.

The deeper concave seen in FIG. 7 can allow single ball release with the potential for using the inside tip to provide an additional launching velocity. If a user yanks the trigger quickly, the inside tip 62 can kick the ball to provide more launch velocity.

The release finger can be made as a deep concave 63, FIG. 7 with a high angle so that the front tip 61 retains the ball to be released in trigger released position but not in trigger pulled position. The high angle release finger can have the back tip 62 retain the line of balls in trigger pulled position so that the back tip 62 only launches out a single ball. The back tip 62 could also be made to launch a finite number of balls such as one, two or three.

Figure 8:
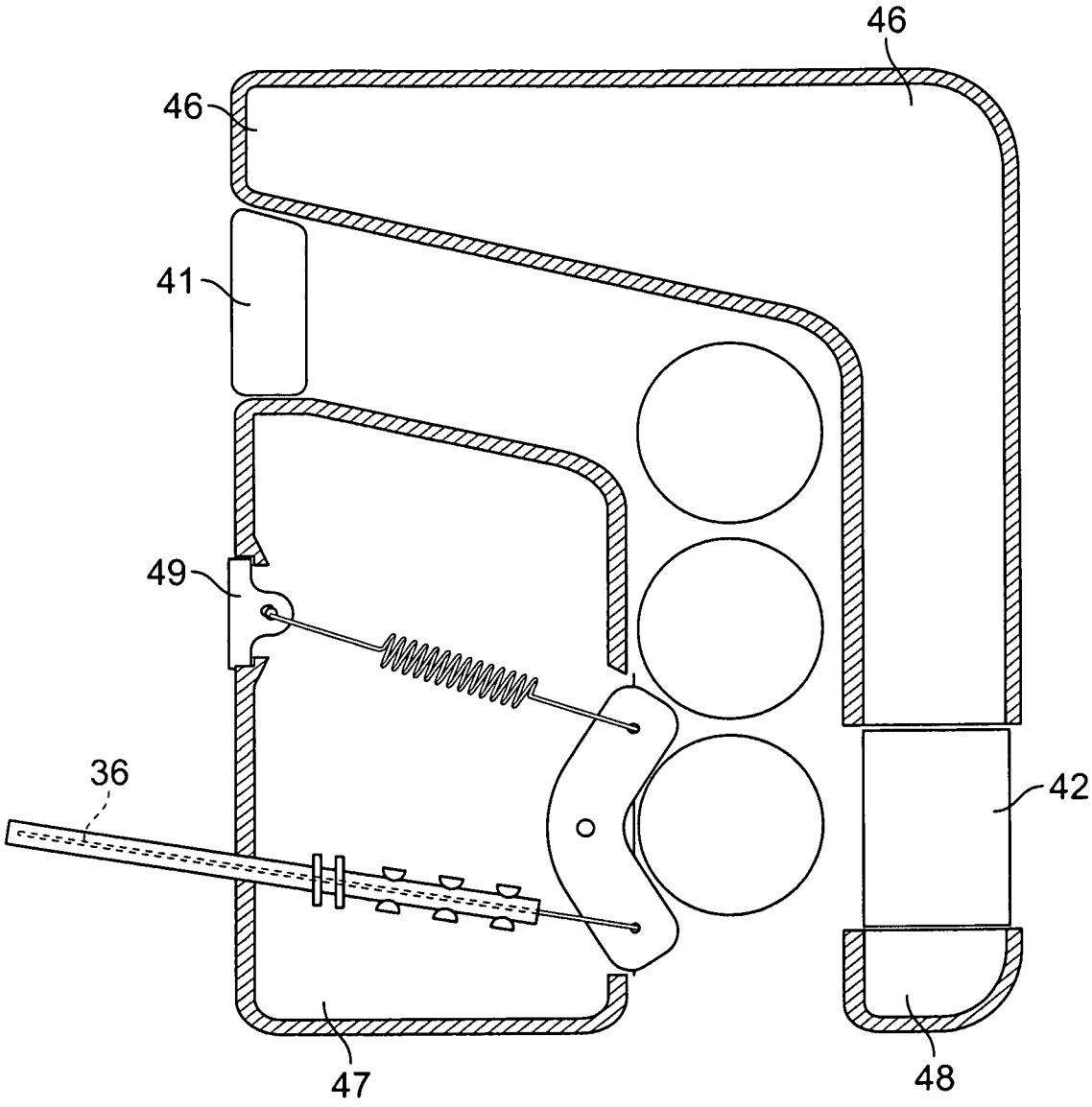
FIG. 8 is a cross-section view of a swing seat having a vertical release.

The orientation of the projectile channel 45 can be vertical as seen in FIG. 8. A vertical projectile channel may allow balls to be retained in a lined up linear orientation or have an enlarged portion to retain balls in a pile or bunch as opposed to a linear orientation. The spring retainer plug 49 can be put on a side of a seat and the pull cable sheath can enter the swing seat body from a side of the swing seat body. The inside body portion 47 can be located on a bottom side as well as a top side of the swing seat body. The outside body portion 46 can be located on a top side as well as a bottom side of the swing seat body. The tip body portion 48 can be located on a bottom side of the swing seat body.

The invention claimed is:

1. A swing game comprising:

a. a top support frame member;

b. a swing hanging from the top support frame member, wherein the swing has a swing seat configured to swing in a front and rear direction;

c. at least two vertical support frame members connected to the top support frame member and supporting the top support frame member d. a rocker support frame member namely a rear rocker support member and a front rocker support member, each of the rear and front rocker support members having a rocker bottom profile, wherein the at least two vertical support frame member is connected to the rocker support frame member, wherein the rocker support frame member is oriented sideways so that the top support frame member is configured to rock in a left and right direction that is perpendicular to a motion of the swing seat in a front and rear direction.

2. The swing game of claim 1, wherein the at least two vertical support frame member comprises four vertical supports, namely a right front vertical support frame member, a left front vertical support frame member, a right rear vertical support frame member, and a left rear vertical support frame member.

3. The swing game of claim 1, wherein the at least two vertical support frame member comprises four vertical supports, namely a right front vertical support frame member, a left front vertical support frame member, a right rear vertical support frame member, and a left rear vertical support frame member; and wherein the rocker support frame member is formed as a rear rocker support frame member and a front rocker support frame member; wherein the right front vertical support frame member and the left front vertical support frame member are connected to and supported by the front rocker support frame, and wherein the right rear vertical support frame member and the left rear vertical support frame member are connected to and supported by the rear rocker support frame.

4. The swing game of claim 3, wherein the swing seat further comprises a ball release mechanism and a trigger assembly, wherein the trigger assembly has a trigger handle configured to actuate the ball release mechanism when the trigger handle is manipulated; and further comprising a plurality of balls held within a projectile hollow.

5. The swing game of claim 4, wherein the projectile hollow is formed as a projectile channel allowing stacking of the plurality of balls in linear orientation.

6. The swing game of claim 4, wherein a pair of bomb bay doors are pivotally mounted to a bottom portion of the swing seat and open to release one or more of the plurality of balls when the trigger handle is manipulated.

7. The swing game of claim 4, further comprising a projectile loading opening formed on a surface of the swing seat, wherein the projectile loading opening is configured to receive the plurality of balls.

8. The swing game of claim 4, further comprising a release finger mounted to the swing seat acting as a gate for controlling ball release.

9. The swing game of claim 1, wherein the swing seat further comprises a ball release mechanism and a trigger assembly, wherein the trigger assembly has a trigger handle configured to actuate the ball release mechanism when the trigger handle is manipulated; and further comprising a plurality of balls held within a projectile hollow.

10. The swing game of claim 9, wherein the projectile hollow is formed as a projectile channel allowing stacking of the plurality of balls in linear orientation.

11. The swing game of claim 9, wherein a pair of bomb bay doors are pivotally mounted to a bottom portion of the swing seat and open to release one or more of the plurality of balls when the trigger handle is manipulated.

12. The swing game of claim 9, further comprising a projectile loading opening formed on a surface of the swing seat, wherein the projectile loading opening is configured to receive the plurality of balls.

13. The swing game of claim 9, further comprising a release finger mounted to the swing seat acting as a gate for controlling ball release.

14. A swing game comprising:

a. a top support frame member;

b. a swing hanging from the top support frame member, wherein the swing has a swing seat configured to swing in a front and rear direction;

c. at least one vertical support frame member connected to the top support frame member and supporting the top support frame member;

wherein the swing seat further comprises a ball release mechanism and a trigger assembly, wherein the trigger assembly has a trigger handle configured to actuate the ball release mechanism when the trigger handle is manipulated; and further comprising a plurality of balls held within a projectile hollow.

15. The swing game of claim 14, wherein the projectile hollow is formed as a projectile channel allowing stacking of the plurality of balls in linear orientation.

16. The swing game of claim 14, wherein a pair of bomb bay doors are pivotally mounted to a bottom portion of the swing seat and open to release one or more of the plurality of balls when the trigger handle is manipulated.

17. The swing game of claim 14, further comprising a projectile loading opening formed on a surface of the swing seat, wherein the projectile loading opening is configured to receive the plurality of balls.

18. The swing game of claim 14, further comprising a release finger mounted to the swing seat acting as a gate for controlling ball release.

* * * * *